US011660876B2

(12) United States Patent
Huang

(10) Patent No.: US 11,660,876 B2
(45) Date of Patent: May 30, 2023

(54) DETECTION METHOD FOR LIQUID LEVEL OF STORAGE TANK

(71) Applicant: KINPO ELECTRONICS, INC., New Taipei (TW)

(72) Inventor: Yao-Te Huang, New Taipei (TW)

(73) Assignee: KINPO ELECTRONICS, INC., New Taipei (TW)

( * ) Notice: Subject to any disclaimer, the term of this patent is extended or adjusted under 35 U.S.C. 154(b) by 28 days.

(21) Appl. No.: 17/572,407

(22) Filed: Jan. 10, 2022

(65) Prior Publication Data

US 2023/0094336 A1 Mar. 30, 2023

(30) Foreign Application Priority Data

Sep. 28, 2021 (CN) ..... 202111143610.3

(51) Int. Cl.
*B41J 2/175* (2006.01)

(52) U.S. Cl.
CPC ..... *B41J 2/17566* (2013.01); *B41J 2/17513* (2013.01); *B41J 2/17523* (2013.01); *B41J 2/17596* (2013.01); *B41J 2002/17573* (2013.01)

(58) Field of Classification Search
CPC .... B41J 2/175; B41J 2/17513; B41J 2/17523; B41J 2/17566; B41J 2/17573; B41J 2/17596; B41J 2/18
See application file for complete search history.

(56) References Cited

U.S. PATENT DOCUMENTS

2009/0195166 A1* 8/2009 Chen ..... H05B 47/115 315/158
2020/0033160 A1* 1/2020 Kim ..... G01D 5/204

FOREIGN PATENT DOCUMENTS

TW I717216 B 1/2021

OTHER PUBLICATIONS

Office Action dated Mar. 29, 2022 of the corresponding Taiwan patent application No. 110135951.

* cited by examiner

*Primary Examiner* — Anh T Vo
(74) *Attorney, Agent, or Firm* — Chun-Ming Shih; HDLS IPR Services

(57) ABSTRACT

A detection method for a liquid level of a storage tank is provided. The detection method determines that an optical sensor is for a liquid level detection purpose when a sensing value to a tank object is consistent with a first threshold condition. The detection method further determines the optical sensor as valid on liquid level detection when sensing values respectively corresponding to statuses of print material and non-print-material are consistent with a second threshold condition. During printing, the detection method starts/stops pouring print material into a storage tank when the sensing value of the optical sensor is consistent with a third threshold condition correspondingly.

15 Claims, 13 Drawing Sheets

DETECTION METHOD FOR LIQUID LEVEL OF STORAGE TANK

BACKGROUND OF THE DISCLOSURE

Technical Field

The technical field relates to a detection method, and more particularly related to a detection method for a liquid level of a storage tank.

Description of Related Art

In the related art, monitoring an ink level of a material tank of a printer (namely, detecting a remaining volume of the printing materials in the material tank) is very important to avoid printing failures or printer malfunctions.

For example, when the remaining capacity of the printing material is insufficient (namely, the ink level is too low), the printing may be interrupted by an exhaustion of the printing material. When the remaining capacity of the printing material is excessive (namely, the ink level is too high), the printer may be malfunction due to a backflow of the printing material.

A float level switch is arranged in the material tank of the printer in the related art to effectively detect whether the ink level is higher/lower than a default level. However, the float level switch is too expensive. Moreover, the float level switch is easily damaged and difficult to be repaired because the float level switch soaks in the printing materials.

If the level float switch is replaced with an optical level switch, there are problems about excluding defect products and configuring a trigger threshold of the optical level switch. More specifically, when a photoelectric sensor of the optical level switch has any defect, the whole optical level switch must be replaced, thereby increasing the product cost. Moreover, the photoelectric sensors manufactured by the consistency manufacturing process may have different sensitivity. Thus, it's an important problem to configure a correct trigger threshold to make sure that the photoelectric sensor may precisely detect the ink level (namely, how to recognize "a status of having-print material" and "a status of non-print-material" effectively).

Thus, the existing level detection method has the above-mentioned problem, and there is a need for a more effective solution.

SUMMARY OF THE DISCLOSURE

The present disclosure is directed to a detection method for a liquid level of a storage tank. The detection method uses a sensor capable of sensing different types of print material to execute a liquid level detection and a liquid level control.

In one of the embodiments, a detection method for a liquid level of a storage tank includes: a) executing a first sensing process on a tank object through an optical sensor to acquire a first sensing value, wherein a transmittance of the tank object is corresponding to a transmittance of a storage tank; b) determining the optical sensor as a liquid level detection purpose when the first sensing value is consistent with a first threshold condition; c) executing a second sensing process on the storage tank through the optical sensor determined as the liquid level detection purpose to acquire a second sensing value corresponding to a status of non-print-material and a third sensing value corresponding to a status of having-print-material, and determining the optical sensor determined as the liquid level detection purpose to be valid on a liquid level detection when the second sensing value is consistent with a second threshold condition and the third sensing value is consistent with a third threshold condition; d) executing a third sensing process on the storage tank through the optical sensor determined as valid on the liquid level detection to acquire a fourth sensing value in a printing procedure; and, e) staring or stopping pouring print materials into the storage tank when the fourth sensing value is consistent with a fourth threshold condition, wherein the fourth threshold condition is corresponding to the second sensing value or the third sensing value.

The present disclosure may eliminate a sensing error generated by an unsuitable optical sensor, and keep a liquid level of the storage tank to be normal.

BRIEF DESCRIPTION OF THE DRAWINGS

The features of the present disclosure are believed to be novel are set forth with particularity in the appended claims. The present disclosure itself, however, may be best understood by reference to the following detailed description of the present disclosure which describes an exemplary embodiment of the present disclosure, taken in conjunction with the accompanying drawings, in which:

DETAILED DESCRIPTION OF THE EMBODIMENTS

The technical contents of this disclosure will become apparent with the detailed description of embodiments accompanied with the illustration of related drawings as follows. It is intended that the embodiments and drawings disclosed herein are to be considered illustrative rather than restrictive.

The present disclosure presents a detection method for a liquid level of a storage tank. In a sorting stage, the detection method may eliminate the optical sensors having hardware defects or other factors and being unsuitable for liquid level detection through a first sorting process. In an onboard stage, the detection method ensures that the optical sensor has an ability to correctly detect a status of non-print-material and a status of having-print material and configures a suitable threshold condition for the optical sensor through a second sorting process. Thus, in an application stage, the detection method may correctly execute the liquid level detection to adjust a liquid level of the print material.

Figure 6:
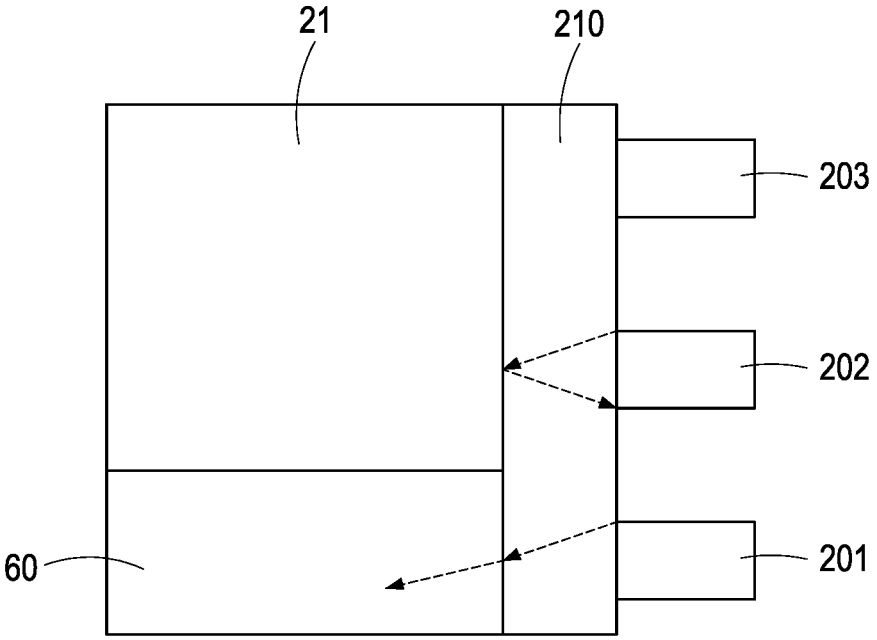
FIG. 6 is a first sensing schematic view of an optical sensor of one embodiment of the present disclosure.

Please refer to FIG. 6, FIG. 6 is a first sensing schematic view of an optical sensor of one embodiment of the present disclosure. FIG. 6 is used to explain how an optical sensor is used in a liquid level detection of a print material in the present disclosure.

The present disclosure arranges a plurality of optical sensors 201-203 on a storage tank 21. The optical sensors 201-203 respectively correspond to different liquid levels. A number of liquid levels (namely, a number of the optical sensors 201-203) may be changed arbitrarily based on requests. The present disclosure doesn't limit the number of optical sensors arranged on the storage tank.

For example, the optical sensor 201 may be arranged at a lower limit liquid level position having the lowest height. As a lower limit liquid level sensor, detecting no print material by the optical sensor 201 expresses that a remaining volume of the print material is too little, and an additional print material is necessary to be poured into the storage tank 21. When the optical sensor 201 detects the print material, the remaining volume of the print material in the storage tank 21 is sufficient.

The optical sensor 202 may be arranged at an upper limit liquid level position having the second-highest height. As an upper limit liquid level sensor, detecting no print material expresses that the remaining volume of the print material is sufficient, and the additional print material may be stopped pouring. When the optical sensor 202 detects the print material, the remaining volume of the print material in the storage tank 21 is too much.

The optical sensor 203 may be arranged at a safety liquid level position having the highest height. As a safety liquid level sensor, detecting no print material expresses that the remaining volume of the print material in the storage tank 21 doesn't cause backflow. When the optical sensor 203 detects the print material, the remaining volume of the print material in the storage tank 21 is more than a safety limit, and there is a backflow risk of the print material. For example, the print material may flow back to an air pressure system through an upper pipe. In one of the embodiments, the optical sensor may be an infrared sensor and include an optical emitter (such as one or more infrared LEDs for emitting an infrared light signal), an optical receiver (such as one or more phototransistors for receiving light signal), and an amplifier drive circuit. The amplifier drive circuit is not a necessary component of the present disclosure.

Furthermore, each of the optical sensors 201-203 may execute a sensing process to acquire a sensing value. The above sensing process may include: emitting the infrared light through the optical emitter; and sensing a voltage triggered by a reflected infrared light as a sensing value, wherein the reflected infrared light is received by the optical receiver.

In one of the embodiments, the optical sensors 201-203 may be arranged inside the storage tank 21. For example, the optical sensors 201-203 may be coated with a light-transparent waterproof protective shell (such as a light-transparent acrylic shell), and the coated optical sensors 201-203 are arranged on an inner wall of the storage tank 21.

In one of the embodiments, the optical emitter may be arranged on the inner wall of the storage tank 21, and the optical receiver may be arranged on an outer wall of the storage tank 21. Thus, this arrangement may reduce a number of penetrating a wall 210 to reduce energy consumption.

In one of the embodiments, a part or the entire wall 210 of the storage tank 21 may be made with a light-transparent material, such that a sensing light (such as the infrared light) emitted by the optical sensors 201-203 may penetrate the wall 210 for sensing a liquid level status inside the wall 210. For example, only the parts corresponding to the arrangement positions of the optical sensors 201-203 are made with the light-transparent material. The light-transparent material may be high light-transparent glass or high light-transparent acrylic, but this specific example is not intended to limit the scope of the present disclosure.

Taking the optical sensor 202 in FIG. 6 for an example, when the storage tank 21 contains no print material, the sensing light of the optical sensor 202 penetrates the solid wall 201 and contacts with air. This situation causes a total internal reflection (an incident angle is greater than a threshold angle of the total internal reflection), and the sensing light will trigger a higher photovoltage (such as 2.8V).

Taking the optical sensor 201 in FIG. 6 for another example, when the storage tank 21 contains the print material (such as a light-transmissive print material 60), the sensing light of the optical sensor 201 penetrates the solid wall 201 and contacts with the liquid print material 60. This situation causes a refraction of the sensing light in the light-transmissive print material 60 because the wall 201 and the print material 60 have densities close to each other, and only less of the sensing light will be reflected to trigger a lower photovoltage (such as less than 1V). The light-transmissive print material 60 may include at least one of a transmissive ink, a high light-transmissive ink, or other high light-transmissive print materials (having a transmittance higher than 70%), etc.

The present disclosure may realize through the above variation characteristics of the photovoltages whether each of the optical sensors 201-203 detects the print material or not.

Figure 8:
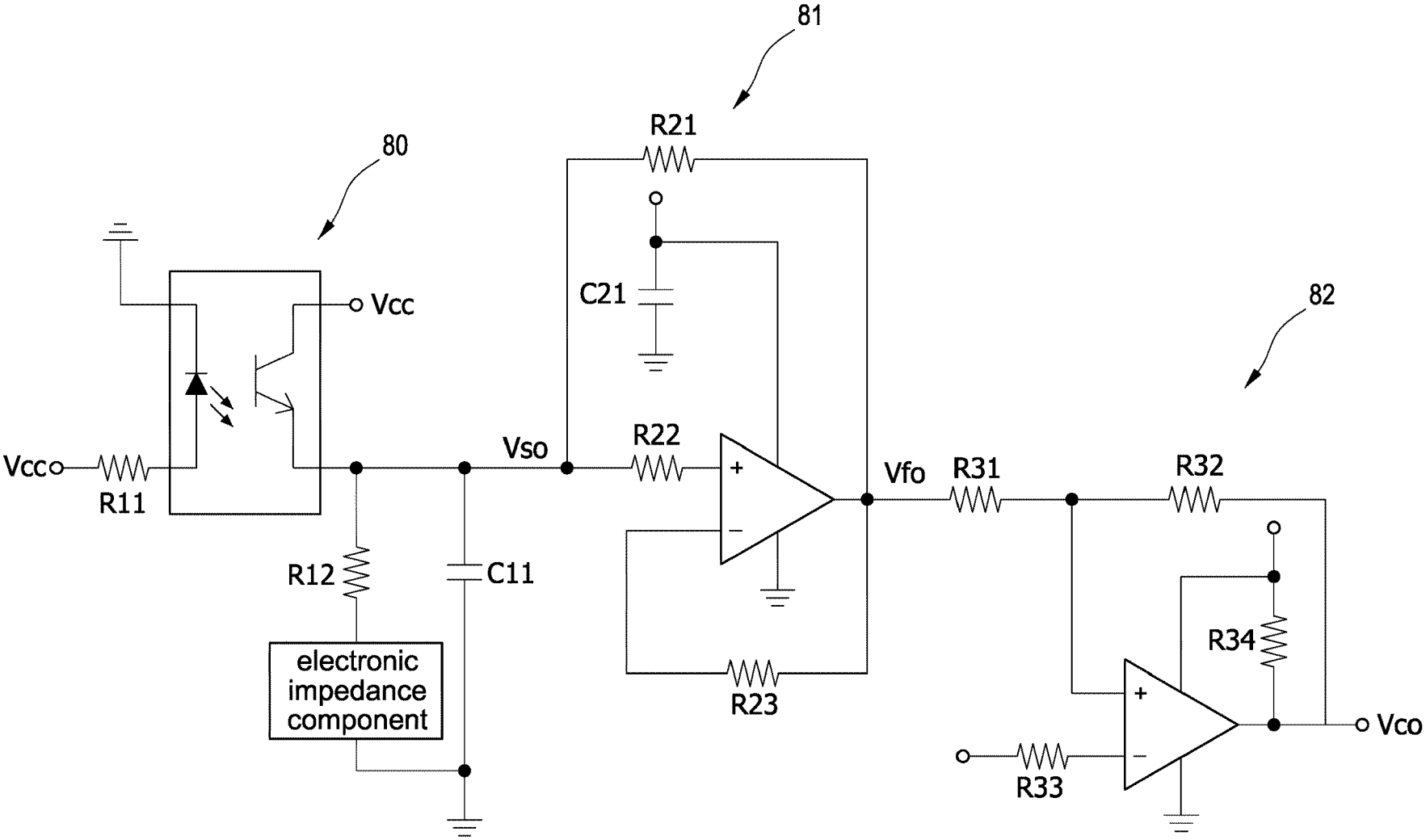
FIG. 8 is a circuit architecture diagram of an optical sensor of one embodiment of the present disclosure.

Please refer to FIG. 8, FIG. 8 is a circuit architecture diagram of an optical sensor of one embodiment of the present disclosure. One or more optical sensors 80 may be arranged on a liquid level control panel in the present disclosure.

The liquid level control panel may be arranged on the storage tank and include a voltage follower circuit 81 and a Schmitt trigger 82. An output of each optical sensor 80 is connected to the voltage follower circuit 81, and an output of the voltage follower circuit 81 is connected to the Schmitt trigger 82.

In one of the embodiments, each optical sensor 80 may be connected to a variable resistance or an electronic impedance device (electronic impedance component).

In one of the embodiments, a sensing process of the optical sensor 80 includes: outputting a voltage signal triggered by a reflected infrared light at the optical sensor 80; executing an analog noise filtering process on the voltage signal at the voltage follower circuit 81 to filter out an analog noise from the voltage signal to generate a filtered voltage signal; and executing a compensating process on the filtered voltage signal at the Schmitt trigger 82 to compensate an error in the filtered voltage signal caused by the print material remaining on a wall of the storage tank.

The voltage follower circuit 81 and the Schmitt trigger 82 are existing circuit components, the relevant description of specific principles and architectures of the voltage follower circuit 81 and the Schmitt trigger 82 are omitted for brevity. One improvement of the present disclosure is that the voltage follower circuit 81 and the Schmitt trigger 82 are applied to the liquid level detection.

Figure 9:
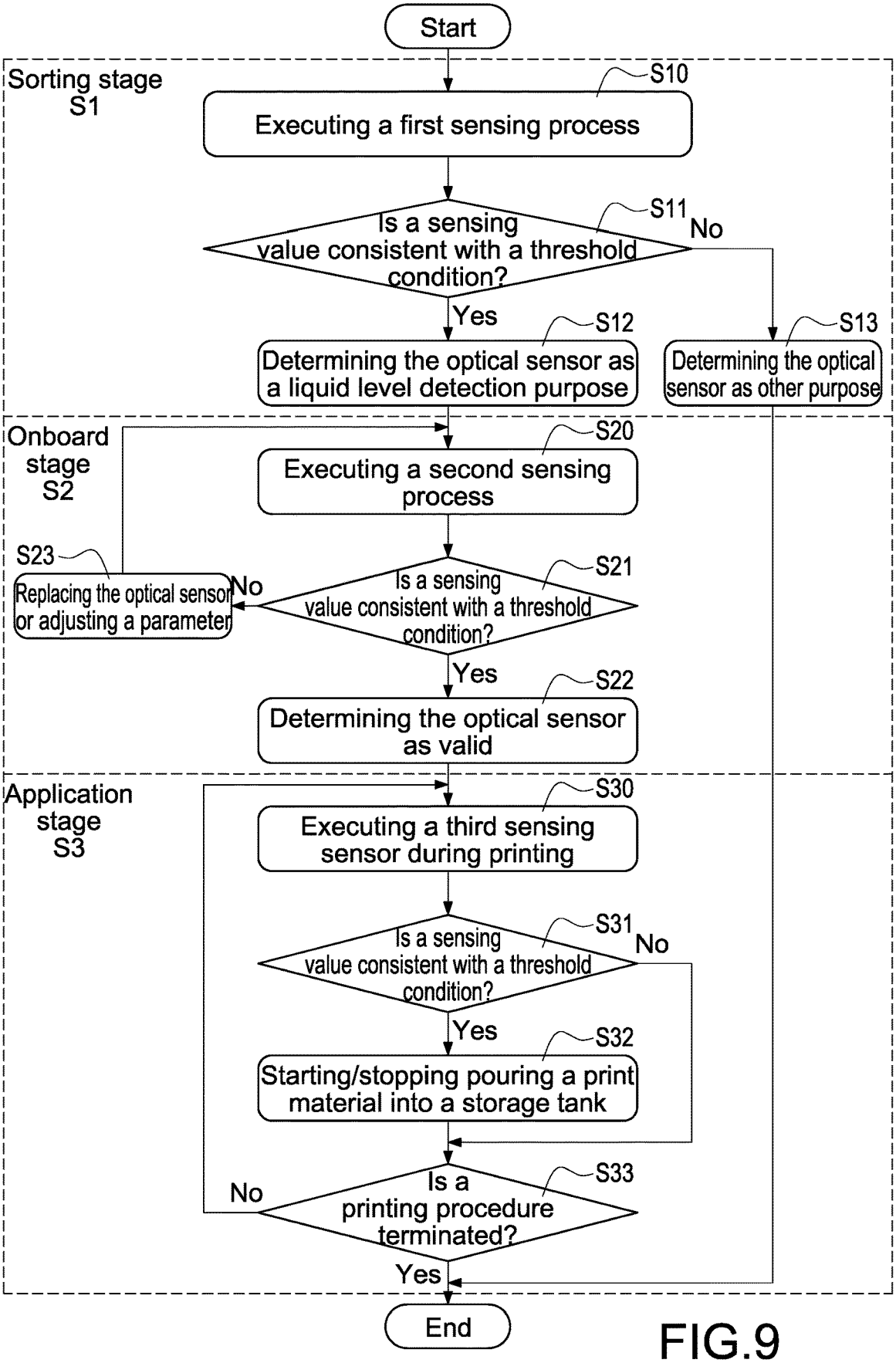
FIG. 9 is a flowchart of a detection method of one embodiment of the present disclosure.

Please refer to FIG. 9, FIG. 9 is a flowchart of a detection method of one embodiment of the present disclosure. The detection method of the present disclosure includes a sorting stage S1, an onboard stage S2, and an application stage S3.

Figure 1:
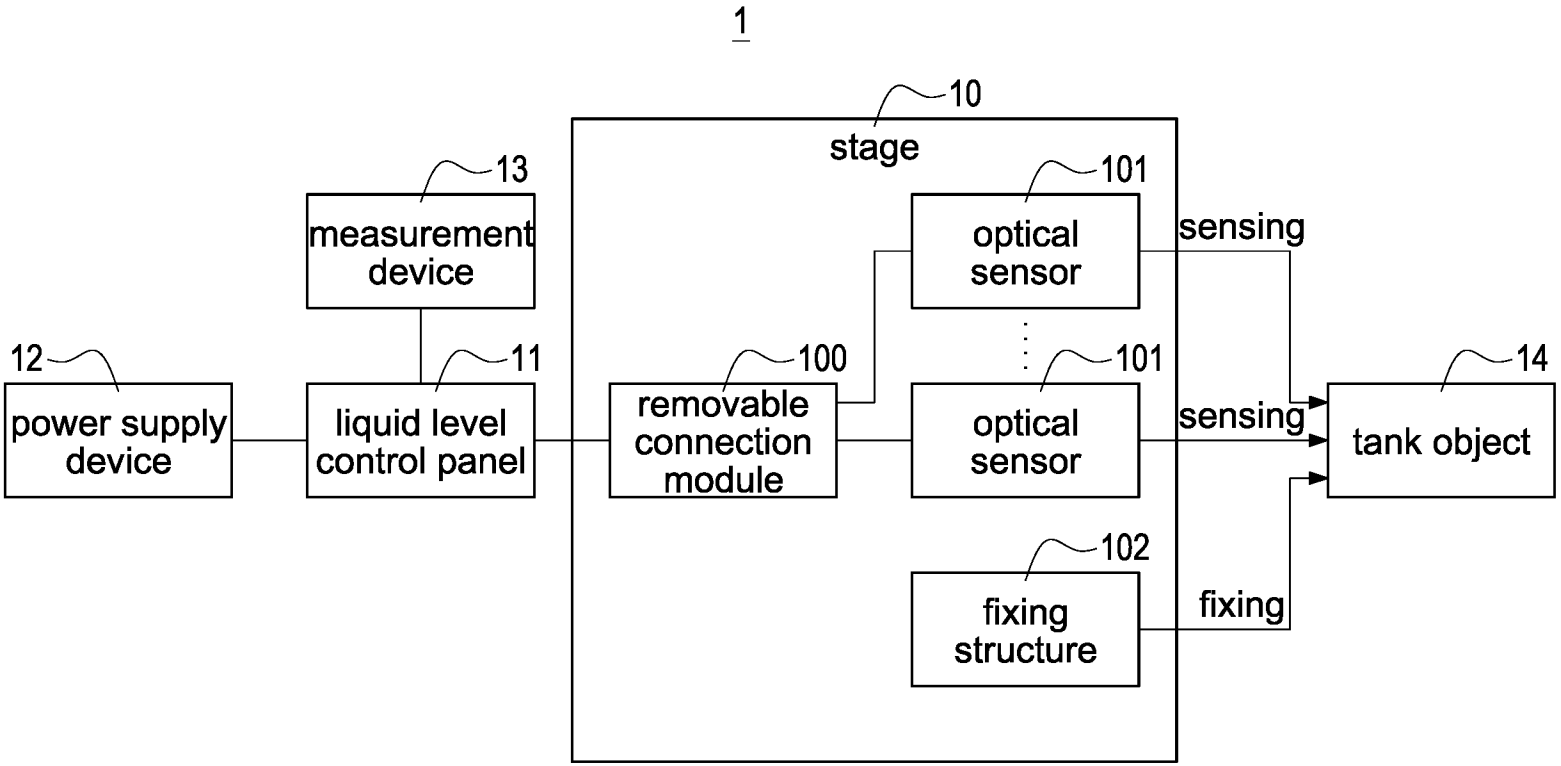
FIG. 1 is an architecture diagram of an inspection fixture of one embodiment of the present disclosure.

First, the sorting stage S1 will be explained. Please refer to FIG. 1 at the same time, wherein FIG. 1 is an architecture diagram of an inspection fixture of one embodiment of the present disclosure. The sorting stage S1 is mainly to apply the inspection fixture 1 to fast eliminate unsuitable optical sensors 101.

In one of the embodiments, the inspection fixture 1 may include a stage 10, a liquid level control panel 11, a measurement device 13, and a power supply device 12.

The stage 10 may include a removable connection module 100 and a fixing structure 102. The removable connection module 100, such as a solderless breadboard, is used to connect the liquid level control panel 11 to one or more optical sensors 101.

In this embodiment of the present disclosure, to make the optical sensor 101 fast connecting to/disconnecting from the liquid level control panel 11, the user only needs to plug/unplug the optical sensor 101 in/out the removable connection module 100. Thus, the user may effectively inspect the optical sensors 101.

The fixing structure 102, such as a latch, a fixture, or other fixable structures, is used to fix the stage 10 on a tank object 14. The tank object 14 is used to simulate a light-transmissive condition of the storage tank. For example, the tank object 14 may have a transmittance, a thickness, or a material, etc. being the same as or similar to the storage tank, but have a less volume than the storage tank. Thus, the tank object 14 is easily used in an inspection.

In one of the embodiments, the tank object 14 may be the practical storage tank, but this specific example is not intended to limit the scope of the present disclosure.

In this embodiment of the present disclosure, the arrangement positions of the removable connection module 100 and the fixing structure 102 are adjusted to make all of the optical sensors 101 connected to the removable connection module 100 to be faced to the tank object 14 for sensing the tank object 14 when the fixing structure 102 is fixed on the tank object 14. The liquid level control panel 11 is used to provide electricity to each of the optical sensors 101 for each optical sensor 101 to emit the infrared light, and the liquid level control panel 11 is used to receive a voltage signal corresponding to the photovoltage of each of the optical sensors 101.

The measurement device 13 is connected to the liquid level control panel 11, and used to measure the voltage value of the photovoltage of each of the optical sensors 101 as a sensing value.

In one of the embodiments, the measurement device 13, such as a multimeter, may be changed to connect to the removable connection module 100 to directly measure the sensing value on the removable connection module 100.

The power supply device 12 is connected to the liquid level control panel 11, and used to provide the electricity, such as 3.3 V of DC power.

Please refer to FIG. 9, the sorting stage may include steps S10-S13.

In the step S10, the optical sensor 101 is connected to the removable connection module 100, and the inspection fixture 1 is operated to execute a first sensing process. More specifically, the optical sensor 101 senses toward the tank object 14, and the measurement device 13 measures the sensing value (a first sensing value) of the optical sensor 101.

The step S11 is to determine whether the first sensing value is consistent with a default threshold condition (a first threshold condition) or not.

In one of the embodiments, the first threshold condition may include: the first sensing value being greater than a first threshold (such as 2.3V) or within a first threshold range (such as 2V-3V).

When the first sensing value is consistent with the first threshold condition, step S12 is performed. In the step S12, the optical sensor 101 is determined to be capable of a liquid level detection purpose. Namely, the optical sensor 101 passes the first sorting process.

When the first sensing value is inconsistent with the first threshold condition, step S13 is performed. In the step S13, the optical sensor 101 is determined to be capable of other purpose, such as a human detection purpose or other non-liquid level detection purpose, etc.

Please be noted that, in addition to hardware defects, one optical sensor 101 may be eliminated in the first sorting process because its sensitivity does not meet a strict condition of the liquid level detection. In this situation, the eliminated optical sensor 101 may be suitable and used for other purposes having a lower sensitivity request to avoid wasting of the optical sensor 101.

Then, a next optical sensor 101 is selected to perform the steps S10-S13 to execute the first sorting process on the next optical sensor 101, and so on. The first sorting process is repeatedly performed until all the optical sensors 101 are inspected.

Figure 2:
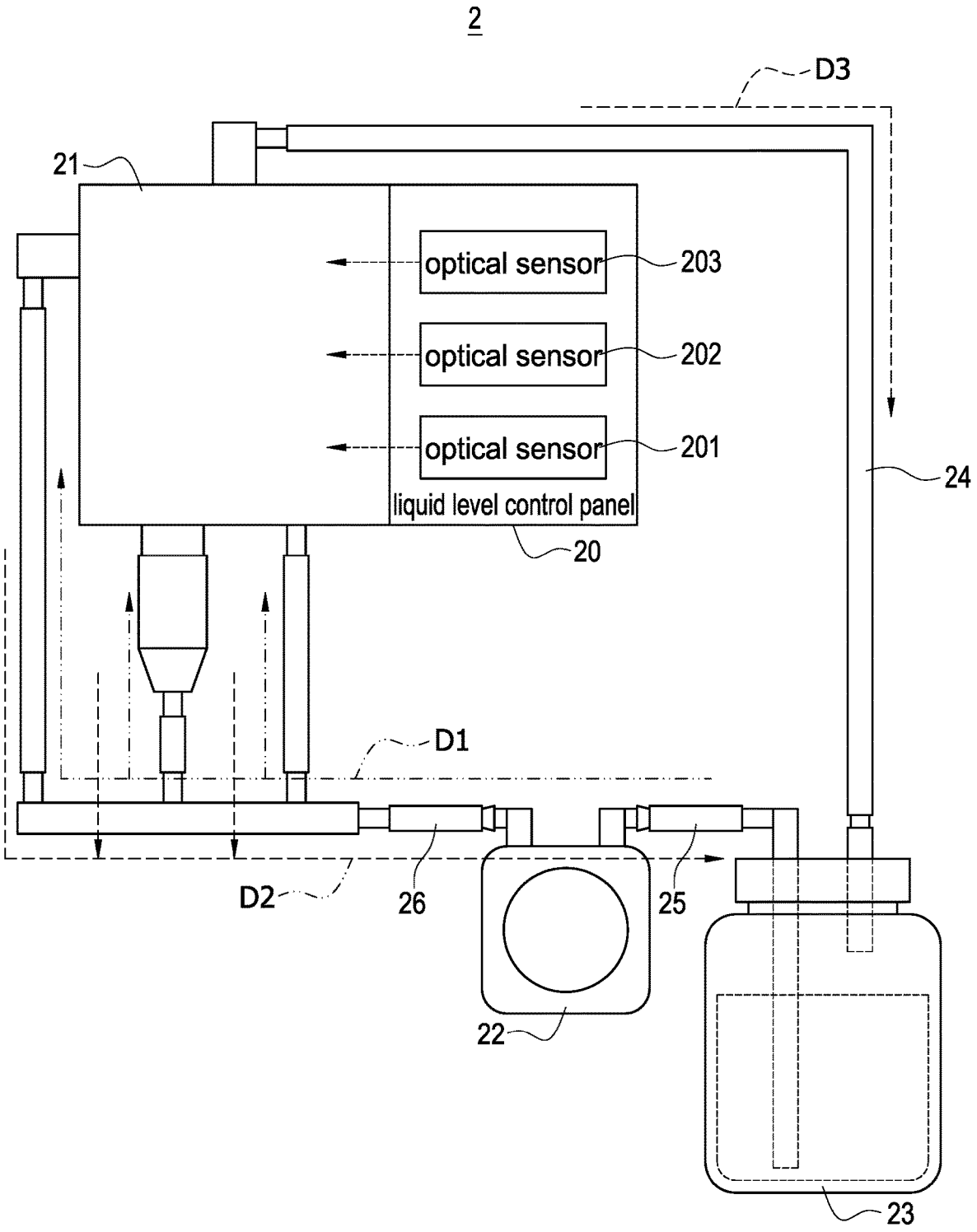
FIG. 2 is an inspection schematic view of an automatic pouring apparatus of one embodiment of the present disclosure.

Then, the onboard stage S2 will be explained. Please refer to FIG. 2 at the same time, wherein FIG. 2 is an inspection schematic view of an automatic pouring apparatus of one embodiment of the present disclosure. In the onboard stage S2, an automatic pouring apparatus 2 is used to inspect a detection ability of a status of non-print-material and a status of having-print-material of the optical sensors 201-203 determined as the liquid level detection purpose. An automatic pouring apparatus 2 may include a liquid level control panel 20, a storage tank 21, a regulating apparatus 22, and a material tank 23 for storing the print material.

The optical sensors 201-203 determined as the liquid level detection purpose in the sorting stage S1 are welded/adhered on the liquid level control panel 20. The liquid level control panel 20 may be arranged on the wall of the storage tank 21 to monitor different liquid levels, and control the regulating apparatus 22 to execute a regulating corresponding to the current liquid level.

The regulating apparatus 22, such as a pump, is electrically connected to the liquid level control panel 20 to be controlled. The regulating apparatus 22 is connected to the material tank 23 through a pipe 25, and connected to the storage tank 21 through a pipe 26.

When the regulating apparatus 22 operates forward, the regulating apparatus 22 may pour the print material along a flowing direction D1 from the material tank 23 to the storage tank 21.

When the regulating apparatus 22 operates backward, the regulating apparatus 22 may pump the print material along a flowing direction D2 from the storage tank 21 to the material tank 23. Thus, the liquid level of the print material in the storage tank 21 may be regulated.

In one of the embodiments, the storage tank 21 is further connected to the material tank 23 through a pipe 24. Thus, the excess print material in the storage tank 21 may flow along a flowing direction D3 to the material tank 23 through the pipe 24.

Please refer to FIG. 9, the onboard stage S2 may include steps S20-S23.

In step S20, a second sensing process is executed through the liquid level control panel 20. In one of the embodiments, the second sensing process is to control the regulating apparatus 22 to extract the print material from the storage tank 21 to make the storage tank 21 to be in a status of non-print-material, to sense the storage tank 21 to acquire a sensing value (a second sensing value) corresponding to the status of non-print-material through each of the optical sensors 201-203. Also, the second sensing process is to control the regulating apparatus 23 to pour the print material to the storage tank 21 to make the storage tank 21 be in a status of having-print-material, and sense the storage tank 21 to acquire a sensing value (a third sensing value) corresponding to the status of having-print-material through each of the optical sensors 201-203.

The step S21 is to determine whether each of the sensing values is consistent with a default threshold condition or not. More specifically, the detection method is to determine whether the second sensing value is consistent with a default second threshold condition corresponding to the status of non-print-material, and determine whether the third sensing value is consistent with a default third threshold condition corresponding to the status of having-print-material.

In one of the embodiments, the second threshold condition may include: the second sensing value being greater than a second threshold (such as 2.4V) or within a second threshold range (such as 2.4V-2.8V).

In one of the embodiments, the first threshold may be less than the second threshold. In one of the embodiments, the third threshold condition may include: the third sensing value being less than a third threshold (such as 1.5V) or within a third threshold range (such as 1.2V-1.5V).

In one of the embodiments, the third threshold may be less than the first threshold.

When the second sensing value is consistent with the second threshold condition and the third sensing value is consistent with the third threshold condition, step S22 is performed: determining the optical sensors 201-203 on the liquid level control panel 20 as valid on a liquid level detection.

When the second sensing value is inconsistent with the second threshold condition and/or the third sensing value is inconsistent with the third threshold condition, step S23 is performed: adjusting a parameter or replacing the optical sensors 201-203.

In one of the embodiments, the liquid level control panel 20 may include a variable resistance or an electronic impedance device. The user may adjust a sensitivity of each of the optical sensors 201-203 through the variable resistance or the electronic impedance device, so as to try to make an adjusted sensing value of the optical sensors 201-203 to be inconsistent with the threshold condition.

When the user is unable to make the sensing value to be consistent with the threshold condition through adjustment, the user may remove (such as desoldering or removing glue) the optical sensors 201-203 from the liquid level control panel 20, and replace the removed optical sensors 201-203 with other optical sensors that have passed the first sorting process.

Thus, the present disclosure may use the first sorting process and the second sorting process to ensure that the optical sensors 201-203 have the good ability of liquid level detection.

Figure 5:
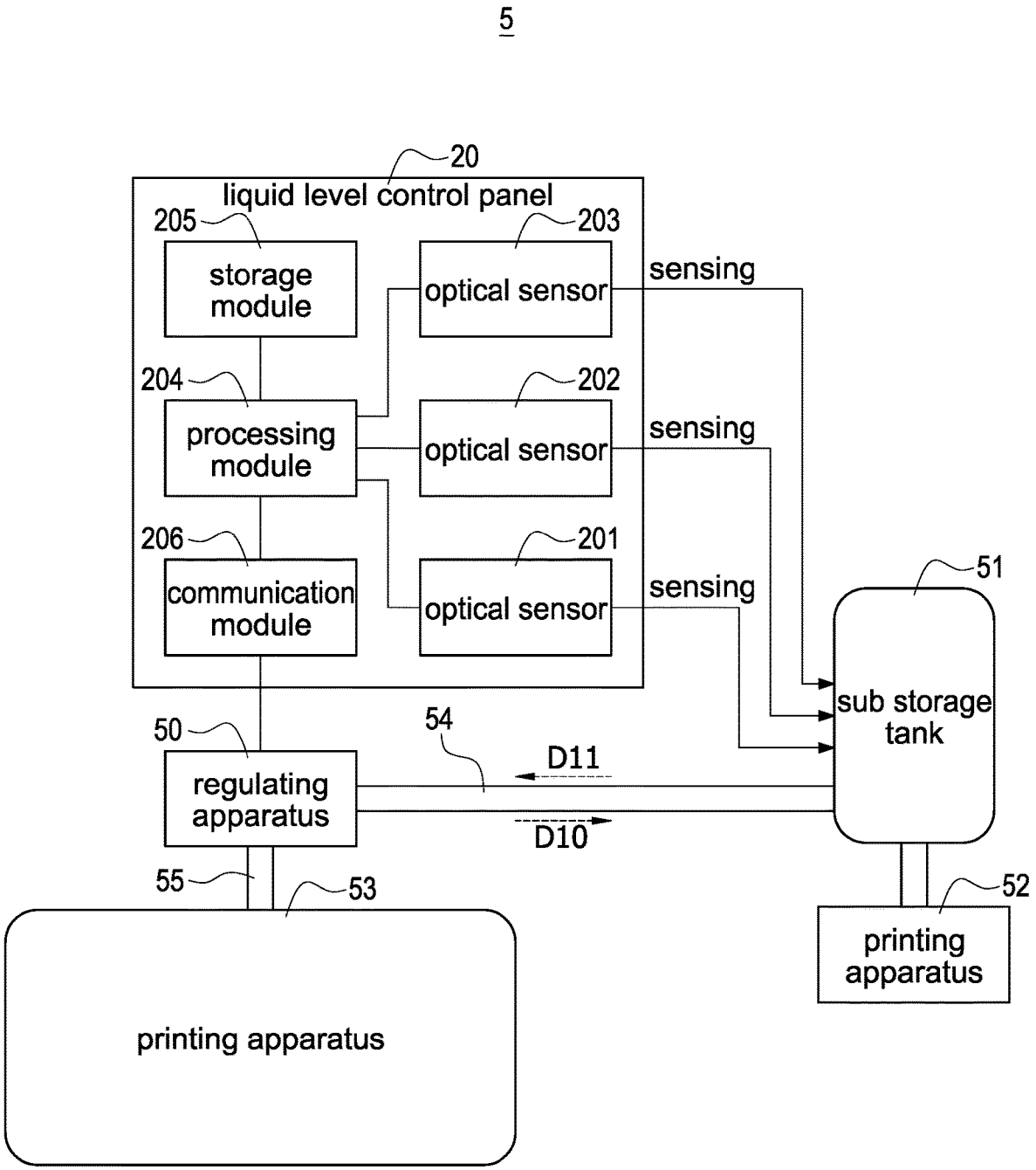
FIG. 5 is an application schematic view of an automatic pouring apparatus of one embodiment of the present disclosure.

Then, the application stage S3 will be explained. Please refer to FIG. 5 at the same time, wherein FIG. 5 is an application schematic view of an automatic pouring apparatus of one embodiment of the present disclosure. In the application stage S3, the automatic pouring apparatus may instantly adjust a remaining volume of the print material in the storage tank based on a current liquid level.

The optical sensors 201-203 passing the first sorting process and the second sorting process are arranged on the liquid level control panel 20. The liquid level control panel 20 is arranged on a sub storage tank 51 (such as the storage tank 21 with a small volume) to monitor different liquid levels through the optical sensors 201-203, and to control a regulating apparatus 50 to execute a regulating action corresponding to the current liquid level.

The regulating apparatus 50 is used to pour the print material from a main storage tank 53 (such as the material tank 23 with a large volume) to the sub storage tank 51 (along a flowing direction D10), or extract the print material from the sub storage tank 51 to the main storage tank 53 (along a flowing direction D11).

In one of the embodiments, the liquid level control panel 20 further includes a storage module 205, a communication module 206, a printing apparatus 52, and a processing module 204 electrically connected to the above modules and the optical sensors 201-203. The storage module 205, such as a flash memory, an EEPMOM, or other non-volatile memory, is used to store data (such as the threshold conditions).

The communication module 206, such as a networking module or a signal transceiver, is used to transmit signals to the regulating apparatus 50.

The printing apparatus 52, such as a printing head, is configured to use the print material in the sub storage tank 51 to execute a printing procedure.

The processing module 204, such as a signal processing circuit, a microcontroller, a CPU, or other processors, is used to compare the sensing values with the threshold conditions correspondingly and generate a control signal to the regulating apparatus 50 based on a comparison result.

Please refer to FIG. 9, the application stage S3 may include steps S30-S33.

In step S30, the detection method is to execute a sensing process (a third sensing process) on the storage tank (the sub storage tank 51) to acquire a sensing value (a fourth sensing value) of each of the optical sensors 201-203 through the liquid level control panel 20. The optical sensors 201-203 of the liquid level control panel 20 had passed the first sorting process and the second sorting process and is valid on the liquid level detection.

In the step S31, the method is to determine whether the fourth sensing value of each of the optical sensors 201-203 is consistent with a default fourth threshold condition.

In one of the embodiments, each threshold condition corresponding to each of the optical sensors 201-203 is determined based on an inspection result of each of the optical sensors 201-203 in the onboard stage S2.

For example, as a lower limit liquid level sensor, the optical sensor 201 may be configured with the fourth threshold condition based on the second sensing value corresponding to the status of non-print-material, such that the optical sensor 201 may detect that the storage tank changes from the status of having-print-material to the status of non-print-material. As the upper limit liquid level sensor and the safety liquid level sensor, the optical sensors 202 and 203 may be configured with the fourth threshold condition based on the third sensing value corresponding to the status of having-print-material, such that the optical sensors 201 and 203 may detect that the storage tank changes from the status of non-print-material to the status of having-print-material.

When the fourth sensing value is consistent with the fourth threshold condition, step S32 is performed: controlling the regulating apparatus 50 to start or stop pouring the print material into the sub storage tank 51.

In one of the embodiments, the present disclosure may start pouring the print material into the sub storage tank 51 when the sensing value of the lower limit liquid level sensor is consistent with the fourth threshold condition, and stop pouring the print material into the sub storage tank 51 when the sensing value of the upper limit liquid level sensor is consistent with the fourth threshold condition. Moreover, the present disclosure may extract the print material from the sub storage tank 51 to the main storage tank 53 when the sensing value of the safety liquid level sensor is consistent with the fourth threshold condition.

When either the fourth sensing value is inconsistent with the fourth threshold condition, or the step S32 is performed completely, step S33 is performed: determining whether a printing procedure is terminated, such as all of the printing works are finished, or the user interrupts the printing.

When the printing procedure is terminated, the detection method is terminated. Otherwise, the printing procedure continues to be executed, and the step S30 is performed again.

Thus, the present disclosure may effectively detect and regulate the liquid level to prevent the printing from failure.

Figure 10:
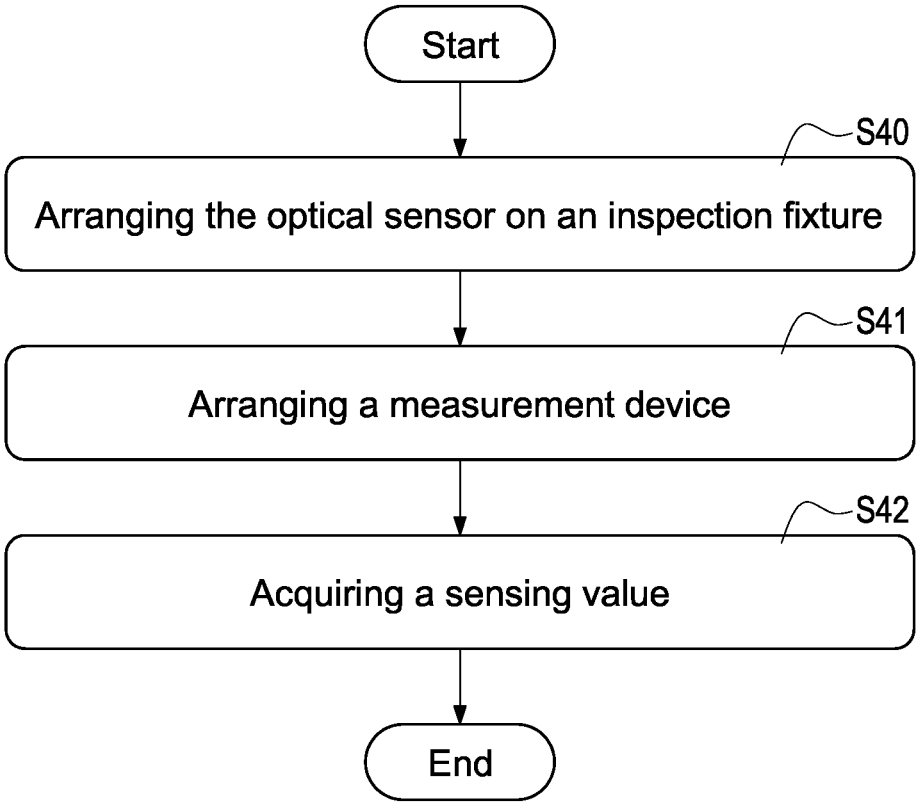
FIG. 10 is a flowchart of a first sensing process of one embodiment of the present disclosure.

Please refer to FIG. 1, FIG. 9, and FIG. 10, FIG. 10 is a flowchart of a first sensing process of one embodiment of the present disclosure. The first sensing process of the step S10 may include steps S40-S42.

In step S40, the optical sensor 101 is removably arranged on the inspection fixture 1 to perform optical sensing toward the tank object 14.

In step S41, the measurement device 13 is connected to the optical sensor 101 for arrangement.

In step S42, a voltage of the optical sensor 101 is acquired through the measurement device 13 to be the first sensing value.

Figure 11:
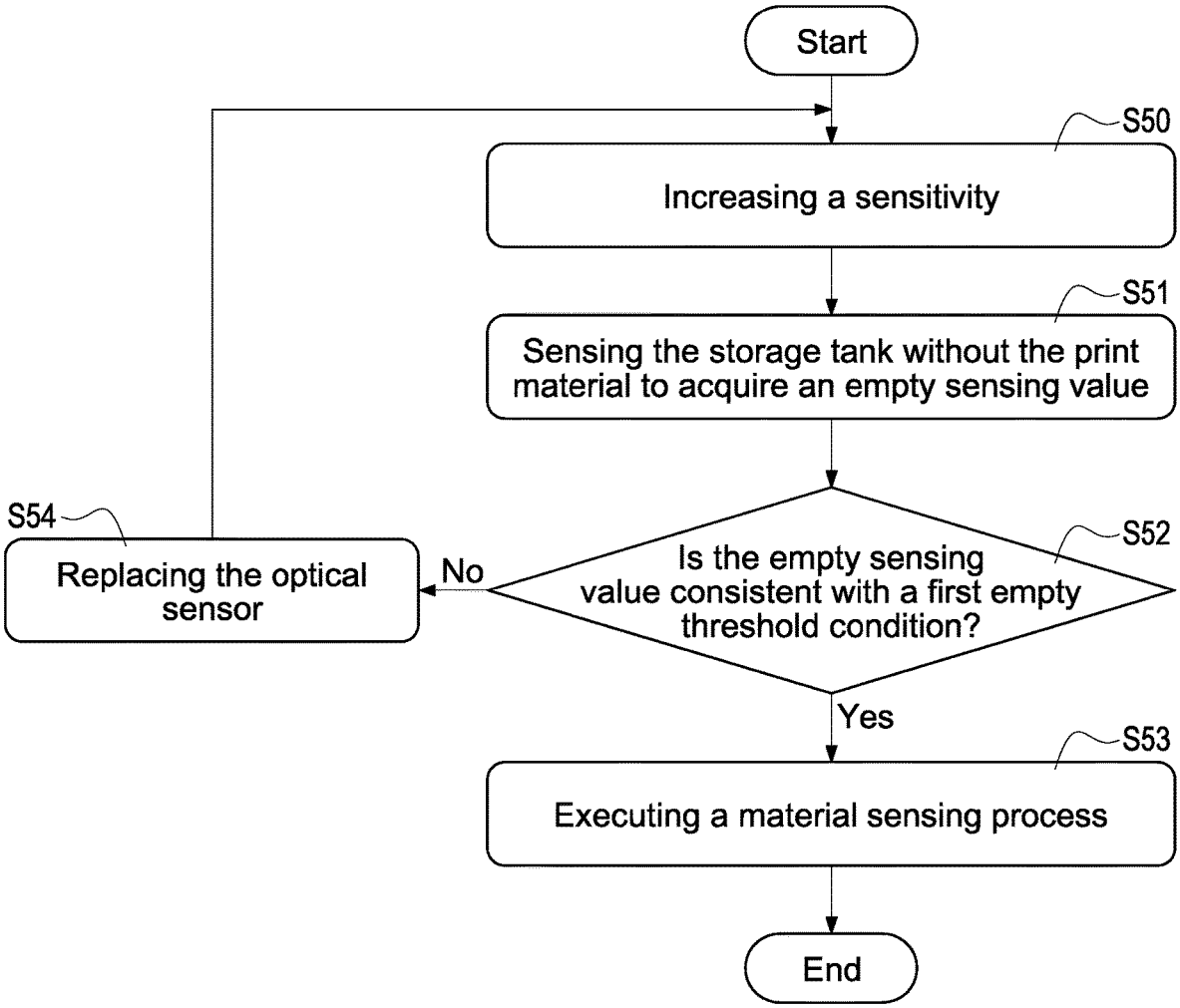
FIG. 11 is a flowchart of a sensing process on an empty tank of one embodiment of the present disclosure.

Please refer to FIG. 9 and FIG. 11 at the same time, wherein FIG. 11 is a flowchart of a sensing process on an empty tank of one embodiment of the present disclosure.

In this embodiment, the sensing process of the step S20 may include an empty sensing process of steps S50-S54. The empty sensing process is used to inspect an ability of the optical sensors 201-203 in detecting the storage tank 21 of the status of non-print-material. The second sensing value may include a first empty sensing value, and the second threshold condition may include a first empty threshold condition.

The empty sensing process of this embodiment may include following steps S50-S53.

In step S50, each of the optical sensors 201-203 is adjusted to increase the sensitivity, thereby increasing a variation range of the sensing value of each of the optical sensors 201-203.

In one of the embodiments, the sensitivity may be adjusted through a variable resistance or an electronic impedance device shown in FIG. 8. For example, the user may adjust the resistance value of the variable resistance to the maximum.

In step S51, the detection method is to execute a sensing process through the optical sensors 201-203 on the storage tank 21 without the print material to acquire a first empty sensing value. The above storage tank 21 without print material (i.e., in the status of non-print material) may be empty or have the print material with the liquid level not entering a sensing zone of each the optical sensors 201-203.

In step S52, the detection method is to determine whether the first empty sensing value is consistent with a default first empty threshold condition.

In one of the embodiments, the first empty threshold condition may include: the first empty sensing value being greater than a first empty threshold (such as 2.4V) or within a first threshold range (such as 2.4V-2.8V).

Figure 12:
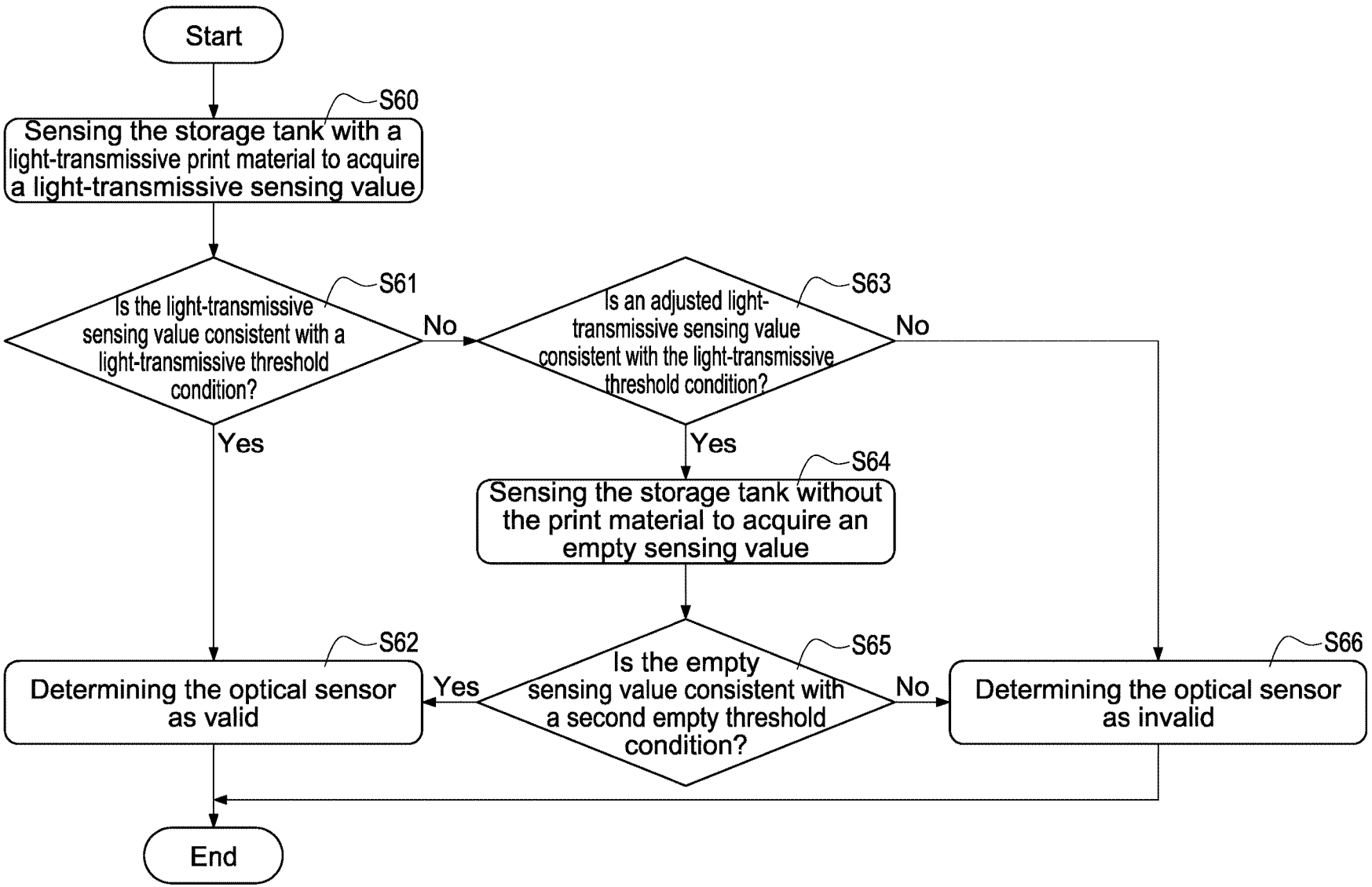
FIG. 12 is a flowchart of a sensing process for a light-transmissive print material of one embodiment of the present disclosure.

When the first empty is consistent with the first empty threshold condition, step S53 is performed: executing a material sensing process, such as a sensing process for light-transmissive print material shown in FIG. 11 or a sensing process for particle print material shown in FIG. 12.

When the first empty is inconsistent with the first empty threshold condition, step S54 is performed: eliminating an unqualified one of the optical sensors 201-203 and replacing the eliminated one of the optical sensors 201-203 with other optical sensor, and performing step S50 on the replaced optical sensor.

Thus, the optical sensors 201-203 passing the above empty sensing process may effectively detect the status of non-print-material.

Please refer to FIG. 9, FIG. 11, and FIG. 12, wherein FIG. 12 is a flowchart of a sensing process for a light-transmissive print material of one embodiment of the present disclosure.

In this embodiment, the second sensing process of step S20 may include a sensing process for the light-transmissive print material of steps S60-S66. The sensing process for the light-transmissive print material is used to inspect an ability of the optical sensors 201-203 in detecting the storage tank 21 with the light-transmissive print material. The third sensing value may include a light-transmissive sensing value, and the third threshold condition may include a light-transmissive threshold condition. Moreover, the second sensing value may include a second empty sensing value, and the second threshold condition may include a second empty threshold condition.

The sensing process for the light-transmissive print material of the embodiment may include following steps S60-S66.

In step S60, the detection method is to execute the sensing process through each of the optical sensors 201-203 on the storage tank 21 with light-transmissive print material to acquire the light-transmissive sensing value.

In steps S61, the detection method is to determine whether the light-transmissive sensing value is consistent with the default light-transmissive threshold condition.

In one of the embodiments, the light-transmissive threshold condition may include: the light-transmissive sensing value being less than a light-transmissive threshold (such as 1.5V) or within a light-transmissive threshold range (such as 1.2V-1.5V).

When the light-transmissive sensing value is consistent with the light-transmissive threshold condition, step S62 is performed: determining the optical sensors 201-203 as valid on the particle print material.

When the light-transmissive sensing value is inconsistent with the light-transmissive threshold condition, step S63 is performed: determining whether an adjusted light-transmissive sensing value is consistent with the light-transmissive threshold condition.

More specifically, the user may adjust the resistance value (such as lowering the resistance value) of the variable resistance or the electronic impedance device to adjust the sensed light-transmissive sensing value, thereby making the adjusted light-transmissive sensing value to be consistent with the light-transmissive threshold condition.

When the light-transmissive sensing value may be consistent with the light-transmissive threshold condition after the adjustment, step S64 is performed: executing the sensing process on the storage tank 21 without print material to acquire the second empty sensing value based on an adjusted resistance value of the variable resistance or the electronic impedance device. In step S65, the detection method is to determine whether the second empty sensing value is consistent with the second empty threshold condition.

In one of the embodiments, the second empty threshold condition may be the same as or similar to the above first empty threshold condition.

When the second empty sensing value acquired after adjusting the resistance value is consistent with the second empty threshold condition, step S62 is performed to determine the optical sensors 201-203 as valid on the light-transmissive print material.

When the user is unable to make the adjusted light-transmissive sensing value to be consistent with the light-transmissive threshold condition through adjustment or the second empty sensing value acquired after adjusting the resistance value is inconsistent with the second empty threshold condition, step S66 is performed: determine the optical sensors 201-203 as invalid on the light-transmissive print material.

Thus, the optical sensors 201-203 passing the above sensing process for the light-transmissive print material may effectively detect a liquid level of the light-transmissive print material.

Figure 7:
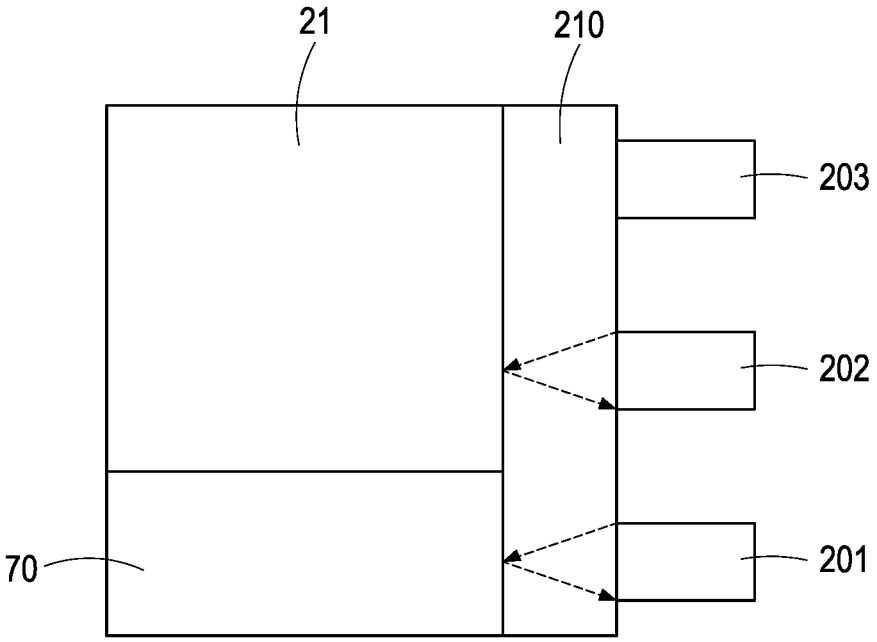
FIG. 7 is a second sensing schematic view of an optical sensor of one embodiment of the present disclosure.

Please refer to FIG. 6 and FIG. 7, wherein FIG. 7 is a second sensing schematic view of an optical sensor of one embodiment of the present disclosure. FIG. 7 is used to explain another problem solved by the present disclosure. The print material may usually be classified into two types, including the light-transmissive print material 60 shown in FIG. 6 and a particle print material 70 shown in FIG. 7.

When the particle print material 60 is stored in the storage tank 21, most of the sensing light (such as the sensing light emitted by the optical sensor 201) is reflected, and the reflected sensing light triggers a higher photovoltage (for example, the photovoltage may be greater than 2.8V). The particle print material may include at least one of white ink, low light-transmissive color ink, and other low light-transmissive print materials (having a transmittance less than 30%), etc.

Moreover, when the storage tank 21 doesn't store the print material, most of the sensing light (such as the sensing light emitted by the optical sensor 202) is reflected, and the reflected sensing light triggers a higher photovoltage (for example, the photovoltage may be greater than 2.4V).

Because a difference between the photovoltages of the above two statuses (the status of non-print-material and the status of having-particle-print-material) is very small, the current liquid level detection method for the optical sensors may be unable to effectively recognize the two statuses.

Figure 13:
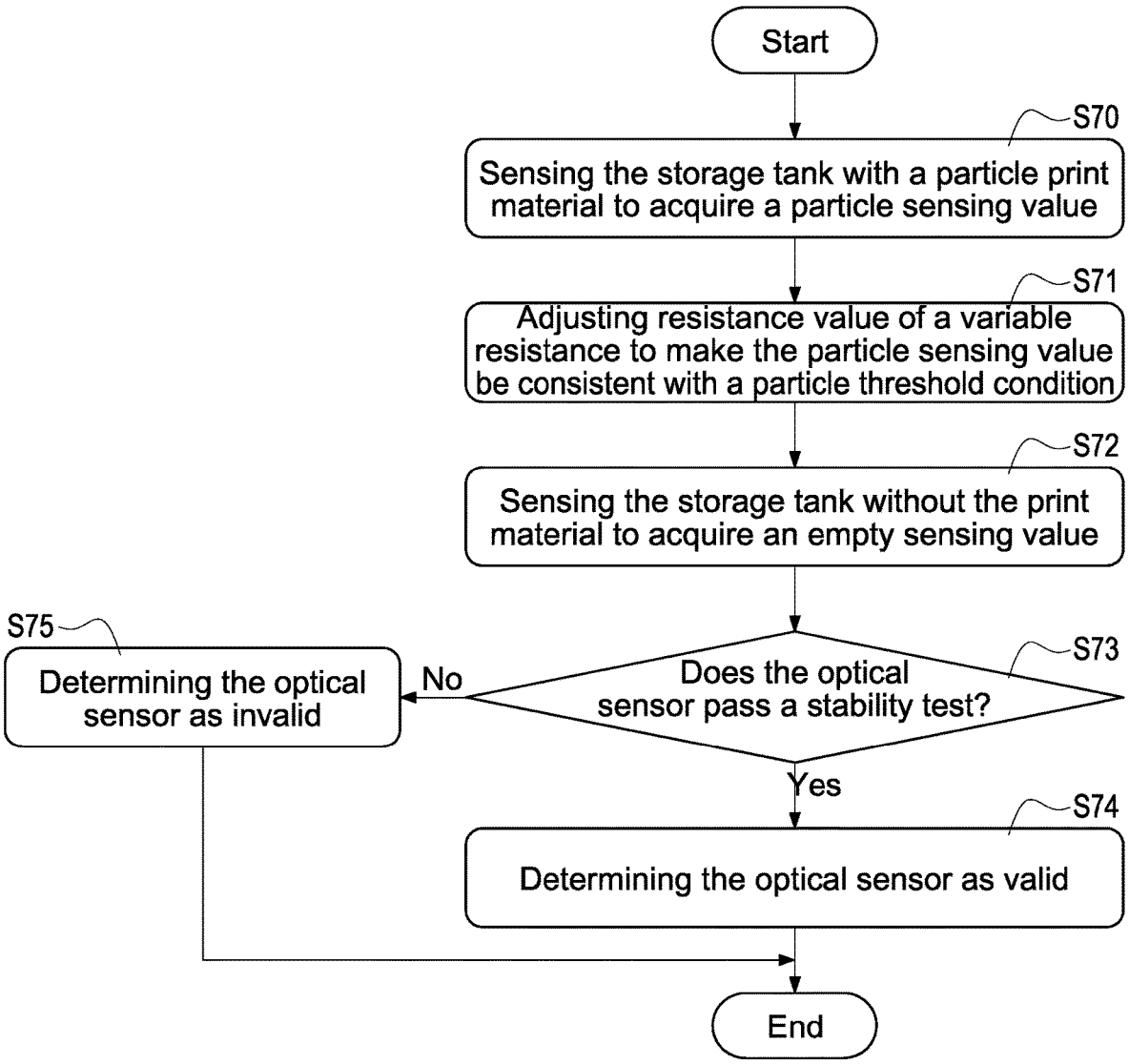
FIG. 13 is a flowchart of a sensing process for a particle print material of one embodiment of the present disclosure.

Please refer to FIG. 9 and FIG. 13, wherein FIG. 13 is a flowchart of a sensing process for a particle print material of one embodiment of the present disclosure.

To solve the above problem, in this embodiment, the second sensing process of the step S20 may include a sensing process for the particle print material of steps S70-S75. The sensing process for the particle print material is used to inspect an ability of the optical sensors 201-203 in detecting the storage tank 21 with the particle print material. The third sensing value may include a particle sensing value, and the third threshold condition may include a particle threshold condition.

The sensing process for the particle print material of the embodiment may include following steps S70-S75.

In step S70, the detection method is to sense the storage tank 21 with the particle print material through each of the optical sensors 201-203 to acquire the particle sensing value. In step S71: the detection method is to adjust the resistance value of the variable resistance or the electronic impedance device so that an adjusted particle sensing value (the first particle sensing value) of each of the optical sensors 201-203 may be consistent with a particle threshold condition (such as a range of 1.2V-1.8V), and to record the particle sensing value (being within 1.2V-1.8V) acquired after adjust the resistance value and the resistance value being adjusted. In step S72, the detection method is to executing the sensing process on the storage tank 21 without the print material through each of the adjusted optical sensors 201-203 to acquire an empty sensing value. When the empty sensing value of any of the adjusted optical sensors 201-203 is inconsistent with the second threshold condition, the corresponding one of optical sensors 201-203 is determined as invalid on the particle print material.

In step S73, the detection method is to determine whether each of the optical sensors 201-203 passes a stability test.

In one of the embodiments, the stability test may include: sensing the storage tank without the print material to acquire an empty sensing value (the third empty sensing value); sensing the storage tank with the particle print material to acquire a particle sensing value (the second particle sensing value); determining that the optical sensor passes the stability test when the third empty sensing value is consistent with the second threshold condition and the second particle sensing value is consistent with the particle threshold condition; and determining that the optical sensor fails to pass the stability test when the third empty sensing value is inconsistent with the second threshold condition and/or the second particle sensing value is inconsistent with the particle threshold condition.

In one of the embodiments, the particle threshold condition may be the particle sensing value being within the particle threshold range (such as 1.2V-1.8V).

In one of the embodiments, when a first particle sensing value that is consistent with the particle threshold range is acquired, the particle threshold condition used in the following stability test may be modified to the acquired first particle sensing value. In other words, the stability test is used to test whether the sensing values (such as the third empty sensing value and the first particle sensing value) of each of optical sensors 201-203 may be stable in either detecting non-print material or the particle print material.

When the optical sensors 201-203 pass the stability test, step S74 is performed: determining the optical sensors 201-203 as valid on the particle print material. When any of the optical sensors 201-203 fails to pass the stability test, step S75 is performed: determining the failed one of the optical sensors 201-203 as invalid on the particle print material.

Thus, the optical sensors 201-203 passing the above sensing process for the particle print material may effectively detect a liquid level of the particle print material.

Please be noted that the stability test is not a necessary process in the present disclosure. For example, when there is a request of shortening an inspection time, the stability test may be omitted.

Figure 14:
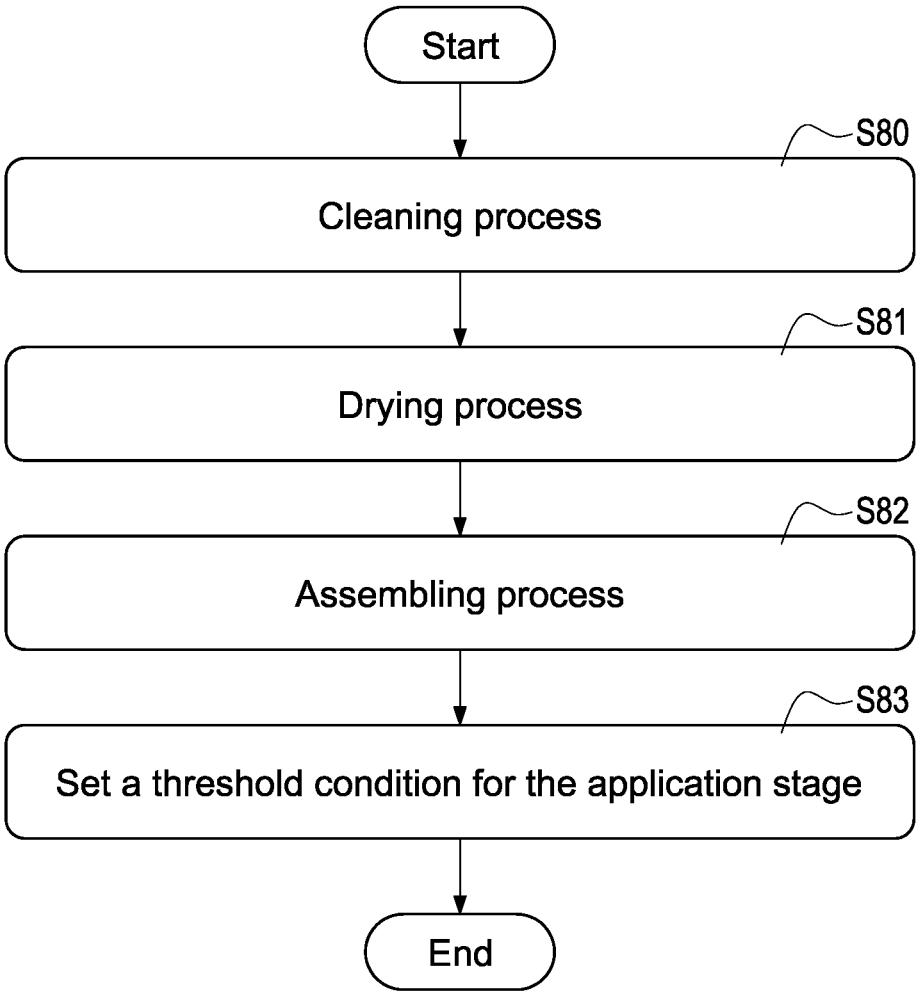
FIG. 14 is a flowchart of an application pre-process of one embodiment of the present disclosure.

Please refer to FIG. 14, FIG. 14 is a flowchart of an application pre-process of one embodiment of the present disclosure. When the onboard stage is finished, the present disclosure may perform steps S80-S83 to clean the storage tank and the pipes, and to process and configure each optical sensor.

In step S80, the detection method is to execute a cleaning process on the storage tank 21 and the pipes to clear the remaining print material in the storage tank 21.

Figure 3:
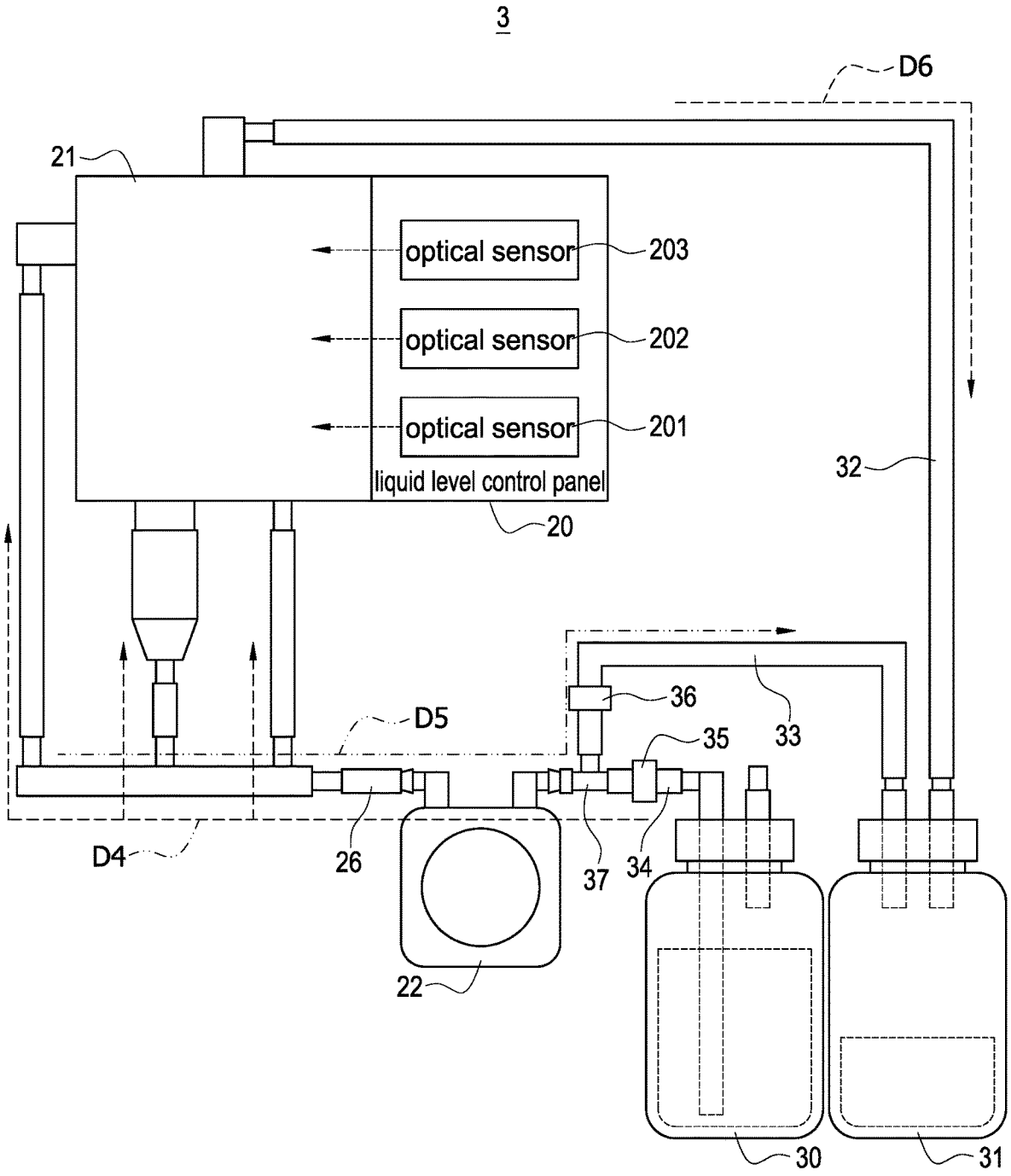
FIG. 3 is a cleaning schematic view of an automatic pouring apparatus of one embodiment of the present disclosure.

Please refer to FIG. 3 at the same time, wherein FIG. 3 is a cleaning schematic view of an automatic pouring apparatus of one embodiment of the present disclosure. An automatic pouring apparatus 3 may include a cleaning solvent tank 30 for storing unused cleaning solvents and a waste solvent tank 31 for storing used cleaning solvents. The above clearing solvents may be 75%-100% alcohol, or other highly volatile solvents, but this specific example is not intended to limit the scope of the present disclosure.

In one of the embodiments, the clearing process may include following steps: connecting the storage tank 21 to the cleaning solvent tank 30 through a pipe 26, an regulating apparatus 22, a pipe 37, an electromagnetic valve 35, and a pipe 34, connecting the storage tank 21 to the waste solvent tank 31 through the pipe 26, the regulating apparatus 22, the pipe 37, an electromagnetic valve 36, and a pipe 33, and connecting the storage tank 21 to the waste solvent tank 31 through a pipe 32; opening the electromagnetic valve 36, closing the electromagnetic valve 35, and pumping all of the print material from the storage tank 21 to the waste solvent tank 31 through the regulating apparatus 22 (the flowing directions D5 and D6); pouring the cleaning solvent into the storage tank 21 from the cleaning solvent tank 30 through the regulating apparatus 22 (the flowing directions D4); waiting for a default time (such as 5 minutes but may be omitted); opening the electromagnetic valve 35, closing the electromagnetic valve 36, and pumping the cleaning solvents from the storage tank 21 to the waste solvent tank 31 through the regulating apparatus 22; repeatedly performing the above steps for a default clearing times (such as three times); removing the cleaning solvent tank 30 and the waste solvent tank 31.

In step S81, the detection method is to execute a drying process on the storage tank 21 and the pipes to clear the remaining print material in the storage tank 21.

Figure 4:
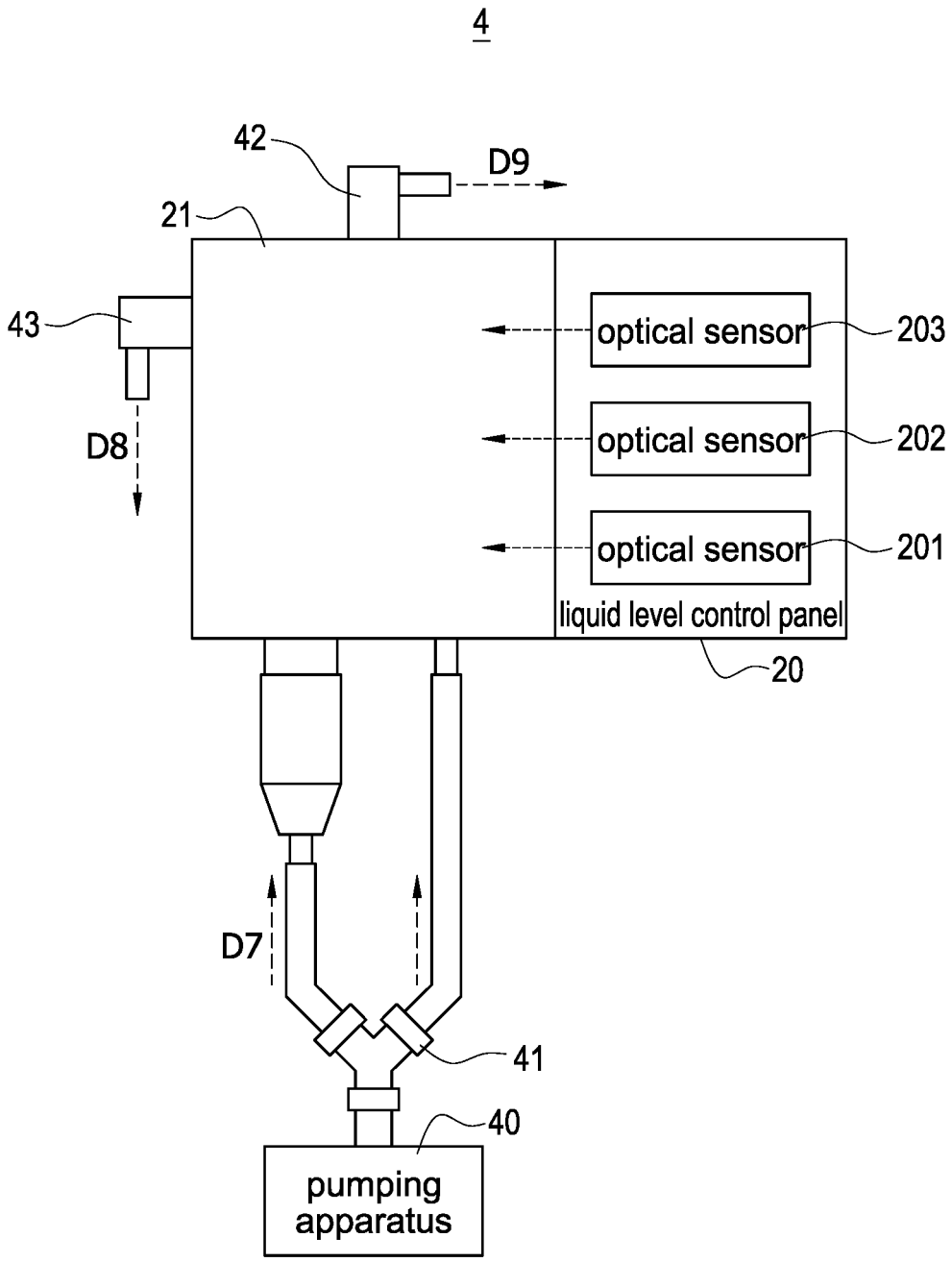
FIG. 4 is a drying schematic view of an automatic pouring apparatus of one embodiment of the present disclosure.

Please refer to FIG. 4, FIG. 4 is a drying schematic view of an automatic pouring apparatus of one embodiment of the present disclosure. An automatic pouring apparatus 4 may include a pumping apparatus 40, such as an air compressor.

In one of the embodiments, the drying process may include following steps: connecting the storage tank 21 to the pumping apparatus 40 through a pipe 41; transmitting a pressurized gas to the storage tank 21 through the pumping apparatus 40 and the pipe 41 for a first default air supply time (such as 2 minutes) to dry the storage tank 21, wherein the pressurized gas flows out of the storage tank 21 through a pipe 42 and a pipe 43 (along the flowing directions D9 and D8); transmitting the pressurized gas to the storage tank 21 again for a second default air supply time (such as 1 minute) to dry the storage tank 21 through the pumping apparatus 40 and the pipe 41 after the first default air supply time had elapsed and a provision of the pressurized gas is stopped; and, removing the pumping apparatus 40. In the embodiment, the second default air supply time may be shorter than the first default air supply time, but this specific example is not intended to limit the scope of the present disclosed example.

In step S82, the detection method is to execute an assembling process.

Please refer to FIG. 5, the assembling process is to assemble a liquid level control panel 20, a sub storage tank 51, a regulating apparatus 50, a main storage tank 53 and a printing apparatus 52.

In one of the embodiments, the liquid level control panel 20 may include a lower limit liquid level sensor and an upper limit liquid level sensor, such as the optical sensors 201-203 arranged at the different positions.

In step S83, the detection method is to set a fourth threshold condition for the application stage S3.

In one of the embodiments, the detection method may determine the fourth threshold condition of the lower limit liquid level sensor based on the second sensing value for the lower limit liquid level sensor to detect whether the liquid level of the print material is lower than the sensing position of the lower limit liquid level sensor. Moreover, the detection method may determine the fourth threshold condition of the upper limit liquid level sensor based on the third sensing value for the upper limit liquid level sensor to detect whether the liquid level of the print material is higher than the sensing position of the upper limit liquid level sensor.

While this disclosure has been described by means of specific embodiments, numerous modifications and variations could be made thereto by those skilled in the art without departing from the scope and spirit of this disclosure set forth in the claims.

What is claimed is:

1. A detection method for a liquid level of a storage tank, the detection method comprising:

a) executing a first sensing process on a tank object through an optical sensor to acquire a first sensing value, wherein a transmittance of the tank object is corresponding to a transmittance of a storage tank;

b) determining the optical sensor as a liquid level detection purpose when the first sensing value is consistent with a first threshold condition;

c) executing a second sensing process on the storage tank through the optical sensor determined as the liquid level detection purpose to acquire a second sensing value corresponding to a status of non-print-material and a third sensing value corresponding to a status of having-print-material, and determining the optical sensor determined as the liquid level detection purpose to be valid on a liquid level detection when the second sensing value is consistent with a second threshold condition and the third sensing value is consistent with a third threshold condition;

d) executing a third sensing process on the storage tank through the optical sensor determined as valid on the liquid level detection to acquire a fourth sensing value in a printing procedure; and e) starting or stopping pouring a print material into the storage tank when the fourth sensing value is consistent with a fourth threshold condition, wherein the fourth threshold condition is corresponding to the second sensing value or the third sensing value.

2. The detection method according to claim 1, wherein the first sensing process comprises:

a1) the optical sensor being removably arranged on an inspection fixture to sense the tank object;

a2) a measurement device being connected to the optical sensor; and a3) acquiring a voltage of the optical sensor as the first sensing value through the measurement device.

3. The detection method according to claim 1, further comprising:

f) determining the optical sensor as a non-liquid level detection purpose when the first sensing value is inconsistent with the first threshold condition.

4. The detection method according to claim 1, wherein the second sensing value comprises a first empty sensing value, and the second threshold condition comprises a first empty threshold condition;

wherein the step c) comprises:

c11) increasing a sensitivity of the optical sensor to increase a variation range of sensing values of the optical sensor;

c12) sensing the storage tank without the print material to acquire the first empty sensing value; and c13) determining the optical sensor as valid on empty tank when the first empty sensing value is consistent with the first empty threshold condition.

5. The detection method according to claim 4, wherein the third sensing value comprises a light-transmissive sensing value, and the third threshold condition comprises a light-transmissive threshold condition;

wherein the step c) further comprises:

c21) sensing the storage tank with a light-transmissive print material to acquire the light-transmissive sensing value; and c22) determining the optical sensor as valid on the light-transmissive print material when the light-transmissive sensing value is consistent with the light-transmissive threshold condition.

6. The detection method according to claim 5, wherein the second sensing value further comprises a second empty sensing value, and the second threshold condition further comprises a second empty threshold condition;

wherein the step c) further comprises:

c23) adjusting a resistance value of a variable resistance or an electronic impedance device connected to the optical sensor to acquire an adjusted light-transmissive sensing value when the light-transmissive sensing value is inconsistent with the light-transmissive threshold condition;

c24) sensing the storage tank without the print material based on the resistance value to acquire the second empty sensing value when the adjusted light-transmissive sensing value is consistent with the light-transmissive threshold condition;

c25) determining the optical sensor as valid on the light-transmissive print materials when the second empty sensing value is consistent with the second empty threshold condition; and c26) determining the optical sensor as invalid on the light-transmissive print materials when the adjusted light-transmissive sensing value is inconsistent with the light-transmissive threshold condition.

7. The detection method according to claim 1, wherein the third sensing value comprises a particle sensing value, and the third threshold condition comprises a particle threshold condition;

wherein the step c) comprises:

c31) sensing the storage tank with a particle print material to acquire the particle sensing value; and c32) determining the optical sensor as valid on the particle print material when the particle sensing value is consistent with the particle threshold condition.

8. The detection method according to claim 7, wherein the step s32) comprises:

determining the optical sensor as valid on the particle print material when the particle sensing value is consistent with the particle threshold condition and the optical sensor passes a stability test;

wherein the stability test comprises:

c321) sensing the storage tank without the print material to acquire a third empty sensing value;

c322) sensing the storage tank with the particle print material to acquire another particle sensing value; and c323) determining that the optical sensor passes the stability test when the third empty sensing value is consistent with the second threshold condition and the another particle sensing value is consistent with the particle threshold condition.

9. The detection method according to claim 1, further comprising following steps after the step c) and before the step d):

g1) connecting the storage tank to a cleaning solvent tank and a waste solvent tank through a pipe;

g2) discharging all of the print material from the storage tank;

g3) pouring a cleaning solvent from the cleaning solvent tank to the storage tank through a regulating apparatus;

g4) discharging the cleaning solvents from the storage tank to the waste solvent tank through the regulating apparatus;

g5) repeatedly performing the step g3) and the step g4) for a default cleaning times; and g6) removing the cleaning solvent tank and the waste solvent tank.

10. The detection method according to claim 9, further comprising following steps after the step g6 and before the step d):

h1) connecting the storage tank to a pumping apparatus through a pipe;

h2 transmitting a pressurized gas to the storage tank for a first default air supply time to dry the storage tank through the pumping apparatus and the pipe;

h3) transmitting the pressurized gas to the storage tank for a second default air supply time to dry the storage tank through the pumping apparatus and the pipe after the first default air supply time had elapsed stopping providing and a provision of the pressurized gas is stopped, wherein the second default air supply time is shorter than the first default air supply time; and h4) removing the pumping apparatus.

11. The detection method according to claim 1, further comprising following steps after the step c) and before the step d):

i1) assembling a liquid level control panel, the storage tank, an regulating apparatus, a main storage tank, and a printing apparatus, wherein the liquid level control panel comprises at least two of the optical sensors determined as valid on the liquid level detection, one of the optical sensors is as a lower limit liquid level sensor and arranged at a lower limit liquid level position, another of the optical sensors is as an upper limit liquid level sensor and arranged at an upper limit liquid level position, and the storage tank is as a sub storage tank;

i2) determining the fourth threshold condition for the lower limit liquid level sensor based on the second sensing value, wherein the fourth threshold condition for the lower limit liquid level is used to determine whether a liquid level of the print material in the sub storage tank is lower than the lower limit liquid level sensor; and i3) determining the fourth threshold condition for the upper limit liquid level sensor based on the third sensing value, wherein the fourth threshold condition for the upper limit liquid level sensor is used to determine whether the liquid level of the print material in the sub storage tank is higher than the upper limit liquid level sensor.

12. The detection method according to claim 11, wherein the step e) comprises:

e1) controlling the regulating apparatus to start pouring the print material from the main storage tank into the sub storage tank when the fourth sensing value of the lower limit liquid level sensor is consistent with the fourth threshold condition of the lower limit liquid level sensor; and e2) controlling the regulating apparatus to stop pouring the print materials from the main storage tank into the sub storage tank when the fourth sensing value of the upper limit liquid level sensor is consistent with the fourth threshold condition of the upper limit liquid level sensor.

13. The detection method according to claim 1, wherein the optical sensor is an infrared sensor;

wherein a sensing process through the optical sensor comprises:

j1) controlling an optical emitter of the optical sensor to emit an infrared light; and j2) sensing a voltage triggered by a reflected infrared light received by an optical receiver of the optical sensor as a sensing value.

14. The detection method according to claim 13, wherein the first threshold condition comprises the first sensing value being greater than a first threshold, the second threshold condition comprises the second sensing value being greater than a second threshold, and the third threshold condition comprises the third sensing value being less than a third threshold, wherein the first threshold is less than the second threshold, and the third threshold is less than the first threshold.

15. The detection method according to claim 1, wherein a liquid level control panel is arranged on the storage tank, and the liquid level control panel comprises a plurality of the optical sensors, a voltage follower circuit, and a Schmitt trigger;

wherein outputs of the optical sensors are connected to the voltage follower circuit, an output of the voltage follower circuit is connected to the Schmitt trigger;

wherein a sensing process through each of the optical sensors comprises:

k1) outputting a voltage signal triggered by a reflected infrared light at the optical sensor;

k2) executing an analog noise filtering process on the voltage signal at the voltage follower circuit to filter out an analog noise from the voltage signal to generate a filtered voltage signal; and k3) executing a compensating process on the filtered voltage signal at the Schmitt trigger to compensate an error in the filtered voltage signal caused by the print material remaining on a wall of the storage tank.

* * * * *